US009896886B2

(12) United States Patent
Cook, III et al.

(10) Patent No.: US 9,896,886 B2
(45) Date of Patent: Feb. 20, 2018

(54) INSULATION ENCLOSURE WITH COMPLIANT INDEPENDENT MEMBERS

(71) Applicant: Halliburton Energy Services, Inc., Houston, TX (US)

(72) Inventors: Grant O. Cook, III, Spring, TX (US); Clayton A. Ownby, Houston, TX (US); Jeff G. Thomas, Magnolia, TX (US)

(73) Assignee: HALLIBURTON ENERGY SERVICES, INC., Houston, TX (US)

( * ) Notice: Subject to any disclaimer, the term of this patent is extended or adjusted under 35 U.S.C. 154(b) by 136 days.

(21) Appl. No.: 14/438,038

(22) PCT Filed: Jun. 25, 2014

(86) PCT No.: PCT/US2014/043982
§ 371 (c)(1),
(2) Date: Apr. 23, 2015

(87) PCT Pub. No.: WO2015/199664
PCT Pub. Date: Dec. 30, 2015

(65) Prior Publication Data

US 2016/0305191 A1 Oct. 20, 2016

(51) Int. Cl.
*B22D 27/00* (2006.01)
*E21B 10/60* (2006.01)
(Continued)

(52) U.S. Cl.
CPC ..... *E21B 10/602* (2013.01); *C21D 9/663* (2013.01); *C21D 9/673* (2013.01); *E21B 10/00* (2013.01);
(Continued)

(58) Field of Classification Search
CPC ..... B22D 27/04; B22D 30/00
(Continued)

(56) References Cited

U.S. PATENT DOCUMENTS 4,113,473 A 9/1978 Gauvry et al.
5,682,823 A * 11/1997 Tihansky ..... B61D 39/00 105/377.08
(Continued)

FOREIGN PATENT DOCUMENTS

CN 201896377 U 7/2011
CN 201907185 U 7/2011
(Continued)

OTHER PUBLICATIONS

International Search Report and Written Opinion for PCT/US2014/043982 dated Mar. 23, 2015.
(Continued)

*Primary Examiner* — Scott Kastler
(74) *Attorney, Agent, or Firm* — McDermott Will & Emery LLP

(57) ABSTRACT

An example insulation enclosure includes an outer shell having an open end and a top end, and an inner shell arranged within the outer shell and including a plurality of sidewall members and a top member. Each sidewall member is independently moveable relative to one another and to the top member, and the plurality of sidewall members and the top member each include a support member and insulation material positioned on the support member. One or more compliant devices arranged between the outer shell and at least one of the plurality of sidewall members and the top member, the one or more compliant devices biasing the at least one of the plurality of sidewall members and the top member against adjacent outer surfaces of a mold disposable within the inner shell.

18 Claims, 6 Drawing Sheets

(51) Int. Cl.

| | |
|---|---|
| ***C21D 9/663*** | (2006.01) |
| ***C21D 9/673*** | (2006.01) |
| ***F27B 17/00*** | (2006.01) |
| ***E21B 10/00*** | (2006.01) |
| ***E21B 10/42*** | (2006.01) |
| *C21D 9/00* | (2006.01) |

(52) U.S. Cl.
CPC ..... *E21B 10/42* (2013.01); *F27B 17/0016* (2013.01); *C21D 9/00* (2013.01)

(58) Field of Classification Search
USPC ..... 164/61
See application file for complete search history.

(56) References Cited

U.S. PATENT DOCUMENTS

| | | | |
|---|---|---|---|
| 6,035,924 | A | 3/2000 | Graham |
| 6,932,145 | B2 | 8/2005 | Frasier et al. |
| 2008/0028891 | A1 | 2/2008 | Calnan et al. |
| 2009/0301682 | A1 | 12/2009 | Proske et al. |
| 2010/0278604 | A1 | 11/2010 | Glass et al. |
| 2013/0180692 | A1 | 7/2013 | Gomez et al. |
| 2013/0180693 | A1 | 7/2013 | Gomez et al. |
| 2013/0313403 | A1 | 11/2013 | Atkins et al. |
| 2015/0375299 | A1* | 12/2015 | Ownby ..... B22D 30/00 164/61 |
| 2016/0318101 | A1* | 11/2016 | Cook, III ..... E21B 10/00 |
| 2016/0346833 | A1* | 12/2016 | Ownby ..... B22C 9/02 |
| 2016/0346835 | A1* | 12/2016 | Ownby ..... B22F 3/14 |

FOREIGN PATENT DOCUMENTS

| | | | |
|---|---|---|---|
| JP | 2014008775 | A | 1/2014 |
| WO | 2015199664 | A1 | 12/2015 |

OTHER PUBLICATIONS

Chinese Office Action from Chinese Patent Application No. 201480077968.2, dated Dec. 20, 2017, 10 pages.

* cited by examiner

INSULATION ENCLOSURE WITH COMPLIANT INDEPENDENT MEMBERS

BACKGROUND

The present disclosure relates to oilfield tool manufacturing and, more particularly, to insulation enclosures that help control the thermal profile of drill bits during manufacture.

Rotary drill bits are often used to drill oil and gas wells, geothermal wells, and water wells. One type of rotary drill bit is a fixed-cutter drill bit having a bit body comprising matrix and reinforcement materials, i.e., a "matrix drill bit" as referred to herein. Matrix drill bits usually include cutting elements or inserts positioned at selected locations on the exterior of the matrix bit body. Fluid flow passageways are formed within the matrix bit body to allow communication of drilling fluids from associated surface drilling equipment through a drill string or drill pipe attached to the matrix bit body. The drilling fluids lubricate the cutting elements on the matrix drill bit.

Matrix drill bits are typically manufactured by placing powder material into a mold and infiltrating the powder material with a binder material, such as a metallic alloy. The various features of the resulting matrix drill bit, such as blades, cutter pockets, and/or fluid-flow passageways, may be provided by shaping the mold cavity and/or by positioning temporary displacement material within interior portions of the mold cavity. A preformed bit blank (or steel shank) may be placed within the mold cavity to provide reinforcement for the matrix bit body and to allow attachment of the resulting matrix drill bit with a drill string. A quantity of matrix reinforcement material (typically in powder form) may then be placed within the mold cavity with a quantity of the binder material.

The mold is then placed within a furnace and the temperature of the mold is increased to a desired temperature to allow the binder (e.g., metallic alloy) to liquefy and infiltrate the matrix reinforcement material. The furnace typically maintains this desired temperature to the point that the infiltration process is deemed complete, such as when a specific location in the bit reaches a certain temperature. Once the designated process time or temperature has been reached, the mold containing the infiltrated matrix bit is removed from the furnace. As the mold is removed from the furnace, the mold begins to rapidly lose heat to its surrounding environment via heat transfer, such as radiation and/or convection in all directions, including both radially from a bit axis and axially parallel with the bit axis. Upon cooling, the infiltrated binder (e.g., metallic alloy) solidifies and incorporates the matrix reinforcement material to form a metal-matrix composite bit body and also binds the bit body to the bit blank to form the resulting matrix drill bit.

Typically, cooling begins at the periphery of the infiltrated matrix and continues inwardly, with the center of the bit body cooling at the slowest rate. Thus, even after the surfaces of the infiltrated matrix of the bit body have cooled, a pool of molten material may remain in the center of the bit body. As the molten material cools, there is a tendency for shrinkage that could result in voids forming within the bit body unless molten material is able to continuously backfill such voids. In some cases, for instance, one or more intermediate regions within the bit body may solidify prior to adjacent regions and thereby stop the flow of molten material to locations where shrinkage porosity is developing. In other cases, shrinkage porosity may result in poor metallurgical bonding at the interface between the bit blank and the molten materials, which can result in the formation of cracks within the bit body that can be difficult or impossible to inspect. When such bonding defects are present and/or detected, the drill bit is often scrapped during or following manufacturing or the lifespan of the drill bit may be dramatically reduced. If these defects are not detected and the drill bit is used in a job at a well site, the bit can fail and/or cause damage to the well including loss of rig time.

BRIEF DESCRIPTION OF THE DRAWINGS

The following figures are included to illustrate certain aspects of the present disclosure and should not be viewed as exclusive embodiments. The subject matter disclosed is capable of considerable modifications, alterations, combinations, and equivalents in form and function, without departing from the scope of this disclosure.

DETAILED DESCRIPTION

The present disclosure relates to oilfield tool manufacturing and, more particularly, to insulation enclosures that help control the thermal profile of drill bits during manufacture.

Disclosed are embodiments of insulation enclosures configured to help control the thermal profile of a matrix drill bit mold, and thereby aid in directional solidification of molten contents within the mold. The insulation enclosure may include an internal shell that provides multiple independently moveable members (e.g., walls) configured to engage the outer surfaces of the mold. In at least some embodiment, the independently moveable walls may allow a given insulation enclosure (i.e., "hot hat") to be compatible with a range of mold dimensions (e.g., diameter and height), rather than a specific mold diameter. Independently moveable walls may also ensure that the insulation enclosure does not tip over the mold while being lowered, and help ensure the mold is centered within the insulation enclosure. The independently moveable members may also ensure intimate contact with or close, controlled positioning next to the mold during the cooling process. Biasing members coupled to the independently moveable members may also be strategically positioned to control or affect the range of movement of the independently moveable members. For example, compliant devices may be coupled to the independently moveable members such that the independently moveable members have a greater range of movement toward the bottom of the insulation enclosure, with less or no range of movement near the top, to provide sufficient clearance in the can to accommodate a mold without excessive "play" in the independently moveable members.

Because the independently movable members are able to physically engage the outer surfaces of the mold, the mold may be predominantly cooled via conduction alternatively or in addition to radiation or convection. As will be appreciated, radiative heat flux is strongly dependent on temperature and significant as compared to conductive heat flux at high temperatures. As a result, the embodiments disclosed herein may facilitate a more controlled cooling process that helps optimize the directional solidification of the molten contents within the mold, thus preventing shrinkage porosity. Through directional solidification, any potential defects may be pushed or urged toward the top regions of the mold where they can subsequently be machined off during finishing operations. Moreover, since the independent members may be radially movable and otherwise compliant, the insulation enclosure may be able to accommodate a wider range of mold sizes than what is currently possible with existing insulation enclosure designs.

Figure 1:
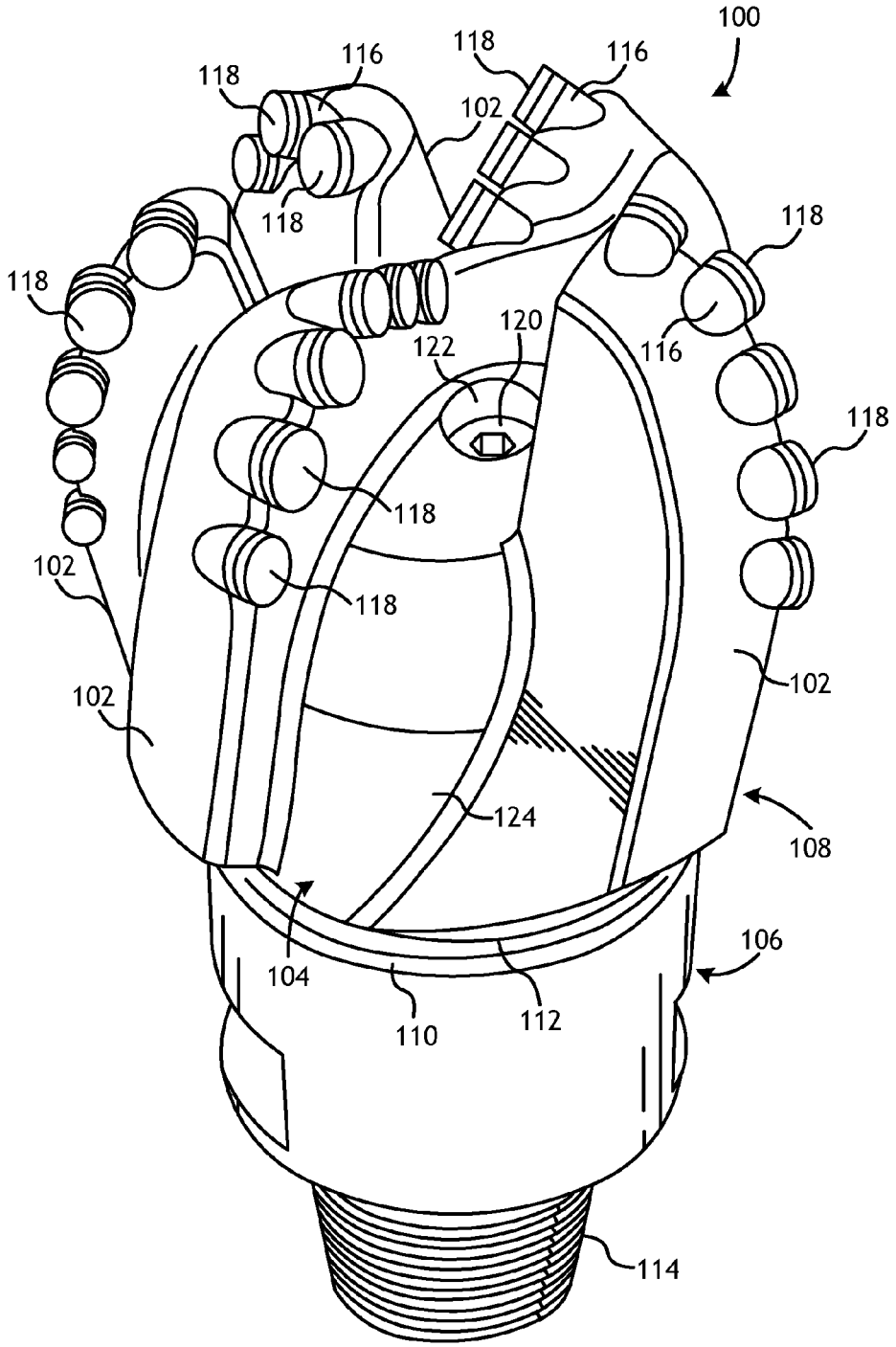
FIG. 1 illustrates an exemplary fixed-cutter drill bit that may be fabricated in accordance with the principles of the present disclosure.

FIG. 1 illustrates a perspective view of an example of a fixed-cutter drill bit 100 that may be fabricated in accordance with the principles of the present disclosure. As illustrated, the fixed-cutter drill bit 100 (hereafter "the drill bit 100") may include or otherwise define a plurality of cutter blades 102 arranged along the circumference of a bit head 104. The bit head 104 is connected to a shank 106 to form a bit body 108. The shank 106 may be connected to the bit head 104 by welding, such as using laser arc welding that results in the formation of a weld 110 around a weld groove 112. The shank 106 may further include or otherwise be connected to a threaded pin 114, such as an American Petroleum Institute (API) drill pipe thread.

In the depicted example, the drill bit 100 includes five cutter blades 102, in which multiple pockets or recesses 116 (also referred to as "sockets" and/or "receptacles") are formed. Cutting elements 118, otherwise known as inserts, may be fixedly installed within each recess 116. This can be done, for example, by brazing each cutting element 118 into a corresponding recess 116. As the drill bit 100 is rotated in use, the cutting elements 118 engage the rock and underlying earthen materials, to dig, scrape or grind away the material of the formation being penetrated.

During drilling operations, drilling fluid (commonly referred to as "mud") can be pumped downhole through a drill string (not shown) coupled to the drill bit 100 at the threaded pin 114. The drilling fluid circulates through and out of the drill bit 100 at one or more nozzles 120 positioned in nozzle openings 122 defined in the bit head 104. Formed between each adjacent pair of cutter blades 102 are junk slots 124, along which cuttings, downhole debris, formation fluids, drilling fluid, etc., may pass and circulate back to the well surface within an annulus formed between exterior portions of the drill string and the interior of the wellbore being drilled (not expressly shown).

Figure 2A:
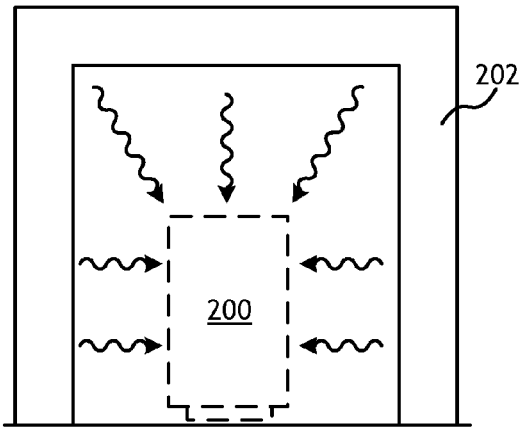
FIGS. 2A-2C illustrate progressive schematic diagrams of an exemplary method of fabricating a drill bit, in accordance with the principles of the present disclosure.
Figure 2B:
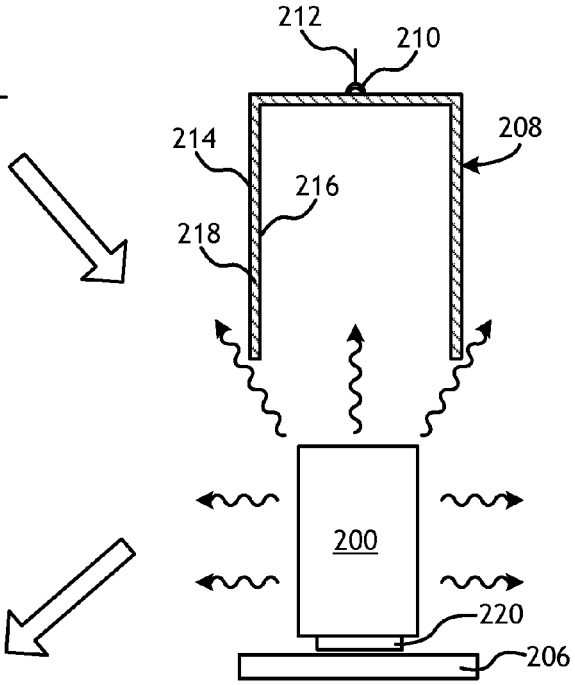
Figure 2C:
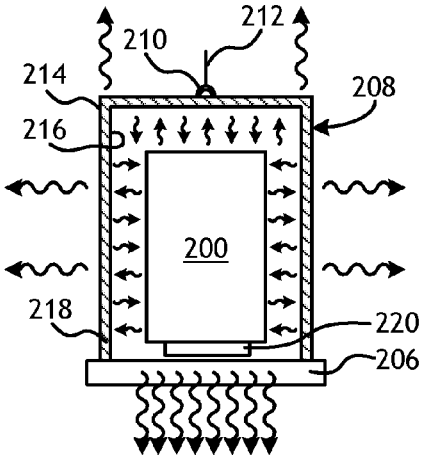

FIGS. 2A-2C are schematic diagrams that sequentially illustrate an example method of fabricating a drill bit, such as the drill bit 100 of FIG. 1, in accordance with the principles of the present disclosure. In FIG. 2A, a mold 200 is placed within a furnace 202. While not specifically depicted in FIGS. 2A-2C, the mold 200 may include and otherwise contain all the necessary materials and component parts required to produce a drill bit including, but not limited to, reinforcement materials, a binder material, displacement materials, a bit blank, etc.

For some applications, two or more different types of matrix reinforcement materials or powders may be positioned in the mold 200. Examples of such matrix reinforcement materials may include, but are not limited to, tungsten carbide, monotungsten carbide (WC), ditungsten carbide ($W_2C$), macrocrystalline tungsten carbide, other metal carbides, metal borides, metal oxides, metal nitrides, natural and synthetic diamond, and polycrystalline diamond (PCD). Examples of other metal carbides may include, but are not limited to, titanium carbide and tantalum carbide, and various mixtures of such materials may also be used. Various binder (infiltration) materials that may be used include, but are not limited to, metallic alloys of copper (Cu), nickel (Ni), manganese (Mn), lead (Pb), tin (Sn), cobalt (Co) and silver (Ag). Phosphorous (P) may sometimes also be added in small quantities to reduce the melting temperature range of infiltration materials positioned in the mold 200. Various mixtures of such metallic alloys may also be used as the binder material.

The temperature of the mold 200 and its contents are elevated within the furnace 202 until the binder liquefies and is able to infiltrate the matrix material. Once a specified location in the mold 200 reaches a certain temperature in the furnace 202, or the mold 200 is otherwise maintained at a particular temperature within the furnace 202 for a predetermined amount of time, the mold 200 is then removed from the furnace 202. Upon being removed from the furnace 202, the mold 200 immediately begins to lose heat by radiating thermal energy to its surroundings while heat is also convected away by cold air from outside the furnace 202. In some cases, as depicted in FIG. 2B, the mold 200 may be transported to and set down upon a thermal heat sink 206. The radiative and convective heat losses from the mold 200 to the environment continue until an insulation enclosure 208 is lowered around the mold 200.

The insulation enclosure 208 may be a rigid shell or structure used to insulate the mold 200 and thereby slow the cooling process. In some cases, the insulation enclosure 208 may include a hook 210 attached to a top surface thereof. The hook 210 may provide an attachment location, such as for a lifting member, whereby the insulation enclosure 208 may be grasped and/or otherwise attached to for transport. For instance, a chain or wire 212 may be coupled to the hook 210 to lift and move the insulation enclosure 208, as illustrated. In other cases, a mandrel or other type of manipulator (not shown) may grasp onto the hook 210 to move the insulation enclosure 208 to a desired location.

In some embodiments, the insulation enclosure 208 may include an outer frame 214, an inner frame 216, and insulation material 218 positioned between the outer and inner frames 214, 216. In some embodiments, both the outer frame 214 and the inner frame 216 may be made of rolled steel and shaped (i.e., bent, welded, etc.) into the general shape, design, and/or configuration of the insulation enclosure 208. In other embodiments, the inner frame 216 may be a metal wire mesh that holds the insulation material 218 between the outer frame 214 and the inner frame 216. The insulation material 218 may be selected from a variety of insulative materials, such as those discussed below. In at least one embodiment, the insulation material 218 may be a ceramic fiber blanket, such as INSWOOL® or the like.

As depicted in FIG. 2C, the insulation enclosure 208 may enclose the mold 200 such that thermal energy radiating from the mold 200 is dramatically reduced from the top and sides of the mold 200 and is instead directed substantially downward and otherwise toward/into the thermal heat sink 206 or back towards the mold 200. In the illustrated embodiment, the thermal heat sink 206 is a cooling plate designed to circulate a fluid (e.g., water) at a reduced temperature relative to the mold 200 (i.e., at or near ambient) to draw thermal energy from the mold 200 and into the circulating fluid, and thereby reduce the temperature of the mold 200. In other embodiments, however, the thermal heat sink 206 may be any type of cooling device or heat exchanger configured to encourage heat transfer from the bottom 220 of the mold 200 to the thermal heat sink 206. In yet other embodiments, the thermal heat sink 206 may be any stable or rigid surface that may support the mold 200, and preferably having a high thermal capacity, such as a concrete slab or flooring.

Accordingly, once the insulation enclosure 208 is arranged about the mold 200 and the thermal heat sink 206 is operational, the majority of the thermal energy is transferred away from the mold 200 through the bottom 220 of the mold 200 and into the thermal heat sink 206. This controlled cooling of the mold 200 and its contents (i.e., the matrix drill bit) allows a user to regulate or control the thermal profile of the mold 200 to a certain extent and may result in directional solidification of the molten contents of the drill bit positioned within the mold 200, where axial solidification of the drill bit dominates its radial solidification. Within the mold 200, the face of the drill bit (i.e., the end of the drill bit that includes the cutters) may be positioned at the bottom 220 of the mold 200 and otherwise adjacent the thermal heat sink 206 while the shank 106 (FIG. 1) may be positioned adjacent the top of the mold 200. As a result, the drill bit may be cooled axially upward, from the cutters 118 (FIG. 1) toward the shank 106 (FIG. 1). Such directional solidification (from the bottom up) may prove advantageous in reducing the occurrence of voids due to shrinkage porosity, cracks at the interface between the bit blank and the molten materials, and nozzle cracks.

While FIG. 1 depicts a fixed-cutter drill bit 100 and FIGS. 2A-2C discuss the production of a generalized drill bit within the mold 200, the principles of the present disclosure are equally applicable to any type of oilfield drill bit or cutting tool including, but not limited to, fixed-angle drill bits, roller-cone drill bits, coring drill bits, bi-center drill bits, impregnated drill bits, reamers, stabilizers, hole openers, cutters, cutting elements, and the like. Moreover, it will be appreciated that the principles of the present disclosure may further apply to fabricating other types of tools and/or components formed, at least in part, through the use of molds. For example, the teachings of the present disclosure may also be applicable, but not limited to, non-retrievable drilling components, aluminum drill bit bodies associated with casing drilling of wellbores, drill-string stabilizers, cones for roller-cone drill bits, models for forging dies used to fabricate support arms for roller-cone drill bits, arms for fixed reamers, arms for expandable reamers, internal components associated with expandable reamers, sleeves attached to an uphole end of a rotary drill bit, rotary steering tools, logging-while-drilling tools, measurement-while-drilling tools, side-wall coring tools, fishing spears, wash-over tools, rotors, stators and/or housings for downhole drilling motors, blades and housings for downhole turbines, and other downhole tools having complex configurations and/or asymmetric geometries associated with forming a wellbore.

According to the present disclosure, controlling the thermal profile of the mold 200 may be enhanced by altering the configuration and/or design of the insulation enclosure 208. More specifically, the embodiments described herein provide an insulation enclosure that includes an internal shell having multiple independently movable members configured to engage the outer surface of the mold 200. The independent members may be radially movable and otherwise compliant and, therefore, able to accommodate a wider range of mold 200 sizes than what is currently possible with existing insulation enclosure designs. The independent members are able to accommodate and physically engage the outer surface of the mold 200, to eliminate or at least reduce or minimize any gap and any corresponding air cavity between the mold 200 and the insulative features of the insulation enclosure. This reliable engagement between the insulating features and the mold 200 helps increase or maximize conductive heat transfer, while reducing or minimizing cooling by radiation and/or convection. Since radiative heat flux is strongly dependent on temperature and is significant compared to conductive heat flux at high temperatures, the embodiments disclosed herein may facilitate a more controlled cooling process for the mold 200 and optimize the directional solidification of the molten contents within the mold 200 (e.g., a drill bit). Through directional solidification, any potential defects (e.g., voids) may be pushed or otherwise urged toward the top regions of the mold where they can be machined off later during finishing operations.

Figure 3:
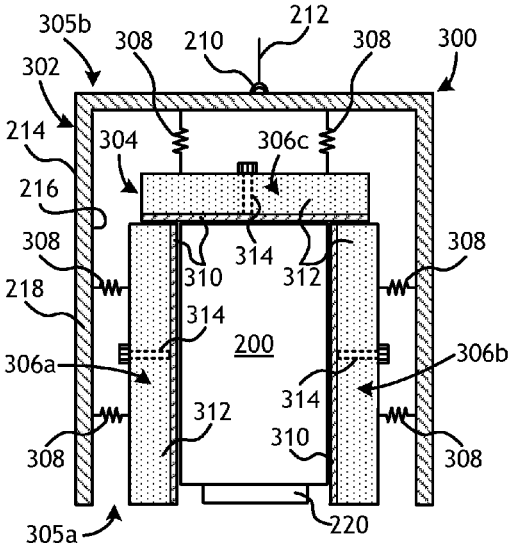
FIG. 3 illustrates a cross-sectional side view of an exemplary insulation enclosure, according to one or more embodiments.

FIG. 3 is a cross-sectional side view of an exemplary insulation enclosure 300, according to one or more embodiments. The insulation enclosure 300 may be similar in some respects to the insulation enclosure 208 of FIGS. 2B and 2C, and therefore may be further understood with reference to those figures as well, where like numerals indicate like elements or components not described again. As illustrated, the insulation enclosure 300 may include an outer shell 302 and an inner shell 304 positioned within the outer shell 302.

In some embodiments, the outer shell 302 may be a rigid structure configured to provide structural support for the inner shell 304. For instance, the outer shell 302 may be made of a rigid material, such as rolled steel, and fabricated (e.g., bent, welded, etc.) into the general shape, design, and configuration capable of accommodating the inner shell 304 therein. In some embodiments, the outer shell 302 may be substantially similar to the insulation enclosure 208 of FIGS. 2B and 2C. For instance, the outer shell 302 may include the outer frame 214, the inner frame 216, and insulation material 218 positioned therebetween.

The outer shell 302 may be configured and otherwise sized to receive the inner shell 304 and the mold 200 therein. To accomplish this, the outer shell 302 may be generally cylindrical and have an open end 305*a* and a top end 305*b*. The open end 305*a* may be shaped so as to be able to receive the inner shell 304 and the mold 200, and the top end 305*b* may provide the hook 210 described above. The outer shell 302 may exhibit any suitable horizontal cross-sectional shape that will accommodate the shape of the inner shell 304 including, but not limited to, circular, ovular, polygonal, polygonal with rounded corners, or any hybrid thereof. In some embodiments, the outer shell 302 may exhibit different horizontal cross-sectional shapes and/or sizes at different vertical locations.

The inner shell 304 may include or otherwise provide a plurality of independent members 306 (shown as members 306*a*, 306*b*, and 306*c*) that allow the internal shell 304 to move independent of and with respect to the outer shell 302. In the illustrated embodiment, the first and second members 306*a,b* may be characterized and otherwise referred to as sidewall members of the inner shell 304, and the third member 306*c* may be characterized and otherwise referred to as a top member of the inner shell 304. While only two sidewall members 306*a,b* are depicted in FIG. 3, more than two sidewall members 306*a,b* may be employed, as discussed below.

Each sidewall and top member 306*a-c* may be movably coupled to the inner surface (e.g., the inner frame 216) of the outer shell 302. For instance, in some embodiments, the sidewall and top members 306*a-c* may be coupled to the inner frame 216 with a coupling member such as, for example, a hinge, track, or support member. Alternatively, or in addition thereto, the sidewall and top members 306*a-c* may be movably coupled to the inner frame 216 with one or more compliant devices 308, which may bias movement of sidewall and top members 306*a-c*. In yet other embodiments, as will be assumed in the present discussion, the compliant devices 308 may each be independent biasing members that couple the sidewall and top members 306*a-c* to the inner frame 216. The compliant devices 308 in this embodiment may be configured to bias and otherwise urge each corresponding sidewall and top member 306*a-c* against an adjacent outer surface of the mold 200. The sidewall and top members 306*a-c* may be physically and structurally independent from each other so that each can conform to varying adjacent outer surfaces of the mold 200.

It should be noted that while two compliant devices 308 are depicted in FIG. 3 as being attached to each sidewall and top member 306*a-c*, it will be appreciated that more or less than two compliant devices 308 may be employed, without departing from the scope of the disclosure. In some embodiments, for instance, the compliant devices 308 may be strategically positioned to control or affect the range of movement of the sidewall and top members 306*a-c*. In at least one embodiment, the compliant devices 308 may be arranged such that the sidewall members 306*a,b* members have a greater range of movement toward the open end 305*a*.

In the illustrated embodiment, the compliant devices 308 are springs, such as coil springs, leaf springs, or the like. In other embodiments, however, the compliant devices 308 may be any type of compliant member, device, or mechanism capable of biasing the sidewall and top members 306*a-c* against the adjacent outer surfaces of the mold 200. In at least one embodiment, for example, one or more of the compliant devices 308 may be an actuation device, such as an air cylinder configured to be pressurized and otherwise actuated to force the sidewall and top members 306*a-c* against the outer surface of the mold 200. In other embodiments, one or more of the compliant devices 308 may be a piston solenoid assembly configured to be actuated such that a piston extends radially to force the sidewall and top members 306*a-c* against the outer surface of the mold 200. Those skilled in the art will readily appreciate the several different variations and/or types of actuation devices (i.e., mechanical, electromechanical, electrical, hydraulic, pneumatic, etc.) that may be used as compliant devices 308 to achieve the ends of the present disclosure.

In yet other embodiments, two or more compliant devices 308 may be used to connect a given sidewall or top member 306*a-c* and may be differing types of compliant devices 308. For example, one compliant device 308 may be an actuated piston and a second compliant device may be a spring. In such an embodiment, the two compliant devices 308 may prove advantageous in slanting a sidewall member 306*a,b* so that the opening between sidewall members near the base is sufficient to accept the mold 200 while the opening between sidewall members at the top of the mold 200 does not change size. Such hybrid compliant/actuation designs could produce certain advantages, such as lower-cost designs, reduced controlling requirements, and assistance in ensuring proper alignment of the insulation enclosure 300 as it lowers. Additional description of the compliant members is given below.

Each sidewall and top member 306*a-c* may be a composite structure made of a support member 310 and insulation material 312 positioned on the support member 310. Having the insulation material 312 positioned on the support member 310 may include the insulation material 312 being coupled to, supported by, and/or in contact with the support member 310 via various configurations. The support member 310 may be made of any rigid material including, but not limited to, metals, ceramics (e.g., a molded ceramic substrate), composite materials, combinations thereof, and the like. In at least one embodiment, the support member 310 may be a metal mesh. In the illustrated embodiment, the insulation material 312 may be attached to the support member 310 using, for example, one or more mechanical fasteners 314 (e.g., screws, bolts, pins, etc.). In other embodiments, however, the insulation material 312 may be attached to the support member 310 using welding or brazing techniques, or combination of welding, brazing and/or mechanical fasteners 314. In other embodiments, as discussed below, the support member 310 may be configured to support the insulation material 312 with a footing 420 (FIG. 4A) and thereby maintain the insulation material 312 in place, perhaps without the use of a fastening or joining method.

The insulation material 312 may include, but is not limited to, ceramics (e.g., oxides, carbides, borides, nitrides, and silicides that may be crystalline, non-crystalline, or semi-crystalline), polymers, insulating metal composites, carbons, nanocomposites, foams, fluids (e.g., air), any composite thereof, or any combination thereof. The insulation material 312 may further include, but is not limited to, materials in the form of beads, particulates, flakes, fibers, wools, woven fabrics, bulked fabrics, sheets, bricks, stones, blocks, cast shapes, molded shapes, foams, sprayed insulation, and the like, any hybrid thereof, or any combination thereof. Accordingly, examples of suitable materials that may be used as the insulation material 312 may include, but are not limited to, ceramics, ceramic fibers, ceramic fabrics, ceramic wools, ceramic beads, ceramic blocks, moldable ceramics, woven ceramics, cast ceramics, fire bricks, carbon fibers, graphite blocks, shaped graphite blocks, polymer beads, polymer fibers, polymer fabrics, nanocomposites, fluids in a jacket, metal fabrics, metal foams, metal wools, metal castings, and the like, any composite thereof, or any combination thereof.

Suitable materials that may be used as the insulation material 312 may be capable of maintaining the mold 200 at temperatures ranging from a lower limit of about −200° C. (−325° F.), −100° C. (−150° F.), 0° C. (32° F.), 150° C. (300° F.), 175° C. (350° F.), 260° C. (500° F.), 400° C. (750° F.), 480° C. (900° F.), or 535° C. (1000° F.) to an upper limit of about 870° C. (1600° F.), 815° C. (1500° F.), 705° C. (1300° F.), 535° C. (1000° F.), 260° C. (500° F.), 0° C. (32° F.), or −100° C. (−150° F.), wherein the temperature may range from any lower limit to any upper limit and encompass any subset therebetween. Moreover, suitable materials that may be used as the insulation material 312 may be able to withstand temperatures ranging from a lower limit of about −200° C. (−325° F.), −100° C. (−150° F.), 0° C. (32° F.), 150° C. (300° F.), 260° C. (500° F.), 400° C. (750° F.), or 535° C. (1000° F.) to an upper limit of about 870° C. (1600° F.), 815° C. (1500° F.), 705° C. (1300° F.), 535° C. (1000° F.), 0° C. (32° F.), or −100° C. (−150° F.), wherein the temperature may range from any lower limit to any upper limit and encompass any subset therebetween. Those skilled in the art will readily appreciate that the insulation material 312 may be appropriately chosen for the particular application and temperature to be maintained within the insulation enclosure 300. Moreover, the examples of the insulation material 312 may equally apply to the insulation material 218 (if used) of the outer shell 302.

In some embodiments, in addition to the materials mentioned above or independent thereof, a reflective coating or material may be positioned on the inner surfaces of one or more of the sidewall and top members 306*a-c* or the outer shell 302. More particularly, the reflective coating or material may be adhered to and/or sprayed onto the inner surface of one or more of the support members 310 or the outer shell 302 to reflect an amount of thermal energy being emitted either from the mold 200 back toward the mold 200 or from the insulation material 312 back toward the insulation material 312. Furthermore, an insulative coating, such as a thermal barrier coating, may be applied to the inner and/or outer surfaces of the support members 310, insulation material 312, or outer shell 302. Such an insulative coating could provide a thermal barrier between adjacent materials, such as the mold 200 and the support members 310, or the support members 310 and the insulation material 312, or could otherwise provide resistance to radiation heat transfer between the insulation material 312 and the outer shell 302 or the compliant devices 308. In other embodiments, or in addition thereto, the inner surface of one or more of the support members 310 may be polished so as to increase its emissivity.

Exemplary operation of the insulation enclosure 300 is now provided. As described above, the mold 200 may be removed from the furnace 202 (FIG. 2A) and placed on a thermal heat sink 206 (FIGS. 2B and 2C) to initiate directional cooling and solidification of the molten contents within the mold 200. The insulation enclosure 300 may then be lowered around the mold 200 using, for example, the hook 210 and the wire 212 or any other type of device that may be able to grasp onto the hook 210 or any portion of the insulation enclosure 300.

As the insulation enclosure 300 is lowered over the mold 200, the internal shell 304 may allow for movement with respect to the outer shell 302 to provide sufficient clearance around the mold 200. More particularly, the sidewall and top members 306*a-c* may be able to move as biased and optionally coupled to the compliant devices 308, so the insulation enclosure 300 may accommodate the particular size and shape of the mold 200. Once fully lowered over the mold 200, the sidewall and top members 306*a-c* may physically contact adjacent outer surfaces of the mold 200 and urged by the compliant devices 308 to maintain such physical contact. In embodiments where one or more of the compliant devices 308 is an actuation device, the compliant devices 308 may be physically retracted while the insulation enclosure 300 is lowered over the mold 200 so as to accommodate the size and shape of the mold 200. Once the insulation enclosure 300 is fully lowered around the mold 200, the compliant devices 308 may be actuated to maintain the sidewall and top members 306*a-c* in physical contact with adjacent outer surfaces of the mold 200.

Having the sidewall and top members 306*a-c* movably and/or compliantly engaged to the outer shell 302 may help prevent the mold 200 from being tipped over or damaged as the insulation enclosure 300 is lowered around the mold 200. Moreover, since the sidewall and top members 306*a-c* are movable, the insulation enclosure 300 may be able to accommodate a wider range of mold 200 sizes, which equates to the ability to manufacture a wider size range of drill bits, tools, or other components by employing the principles of the present disclosure.

With the sidewall and top members 306*a-c* in physical contact with the mold 200, the thermal energy transferred from the mold 200 via radiation and/or convection may be minimized or completely reduced such that the thermal energy of the mold 200 is significantly transferred via conduction from the top and sides of the mold 200 through conduction in the mold 200 (and potentially the inner shell 304) substantially downward and otherwise toward/into the thermal heat sink 206 via the bottom 220 of the mold 200. As a result, the thermal profile of the mold 200 (and its molten contents) may be controlled such that directional solidification of the molten contents within the mold 200 is substantially achieved in the axial direction (e.g., toward the bottom 220 of the mold 200) rather than the radial direction (through the sides of the mold 200). Accordingly, cooling of the mold 200 may be generally facilitated axially upward, from the bottom 220 of the mold 200 toward the top member 306*c* of the inner shell 304.

In the illustrated embodiment, the support members 310 are depicted as being positioned on the interior of the inner shell 304 and otherwise in direct contact with adjacent outer portions of the mold 200, and the insulation material 312 is depicted as being positioned on the exterior of the inner shell 304. In such embodiments, the compliant devices 308 may be attached to the inner surface of the outer shell 302 at one end and attached at the other end to either the insulation material 312 or extend through the insulation material 312 to be coupled to the corresponding support member 310.

Figure 4A:
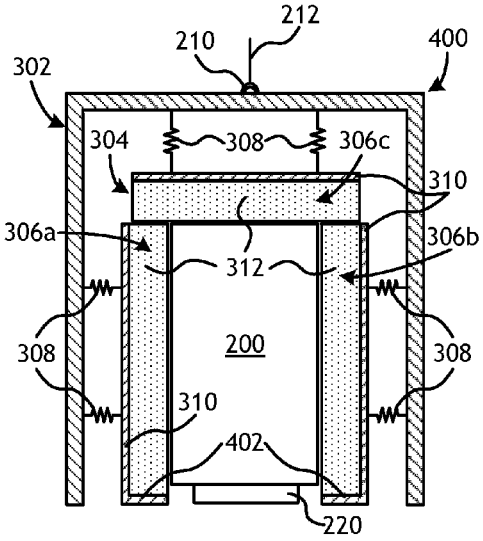
FIGS. 4A-4C illustrate cross-sectional side views of various embodiments of another exemplary insulation enclosure, according to one or more embodiments.
Figure 4B:
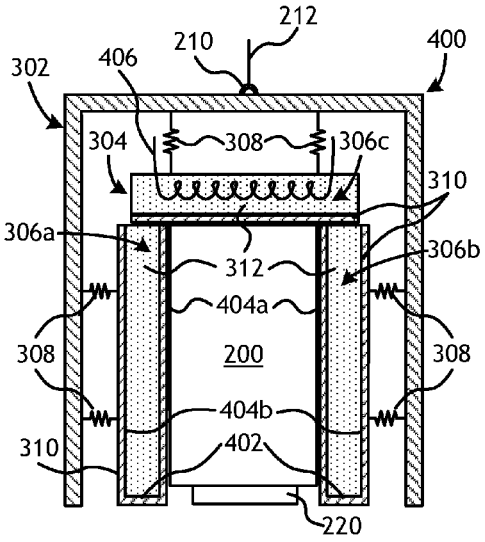
Figure 4C:
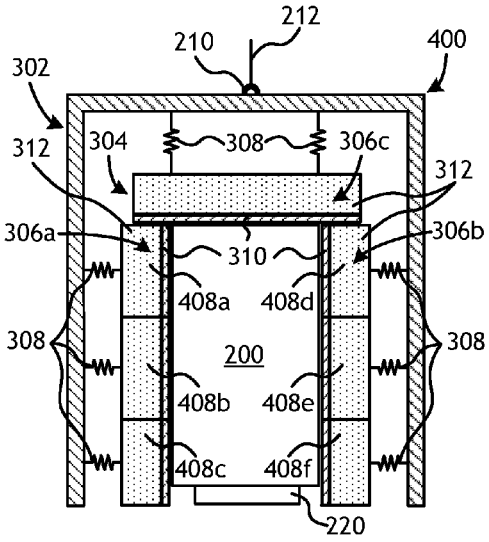

FIGS. 4A-4C are cross-sectional side views of various embodiments or configurations of an insulation enclosure 400. The insulation enclosure 400 may be substantially similar to the insulation enclosure 300 of FIG. 3 and therefore may be best understood with reference also to FIG. 3, where like numerals represent like elements or components not described again in detail. Similar to the insulation enclosure 300 of FIG. 3, the insulation enclosure 400 of FIGS. 4A-4C may include the outer shell 302 and the inner shell 304, where the inner shell 304 includes the plurality of sidewall and top members 306*a-c* that allow the internal shell 304 to move independent of and with respect to the outer shell 302. Moreover, each sidewall and top member 306*a-c* may be movably or compliantly coupled to the inner surface of the outer shell 302 using one or more compliant devices 308.

Unlike the insulation enclosure 300 of FIG. 3, however, the sidewall and top members 306*a-c* in the insulation enclosure 400 of FIGS. 4A-4C may exhibit different designs or configurations. More particularly, and with reference to FIG. 4A, the support members 310 of each sidewall and top member 306*a-c* may be positioned on the exterior of the inner shell 304 while the insulation material 312 is urged into direct contact with adjacent outer portions of the mold 200 with the compliant devices 308. In such embodiments, the compliant devices 308 may be attached to the inner surface of the outer shell 302 at one end and directly attached at the other end to the corresponding support member 310.

Moreover, in at least one embodiment, the support members 310 of the sidewall members 306*a,b* may include a footing 402 that extends substantially horizontal. The footing 402 may serve as a support for the insulation material 312 and may prove especially useful when the insulation material 312 includes stackable and/or individual component materials such as ceramic blocks or rings, moldable ceramics, cast ceramics, fire bricks, graphite blocks or rings, shaped graphite blocks, metal castings, and any combination thereof. As will be appreciated, the footings 402 may equally be applied to the insulation enclosure 300 of FIG. 3, without departing from the scope of the disclosure.

With reference to FIG. 4B, the support members 310 of the sidewall members 306*a,b* may be positioned on both the interior and exterior of the inner shell 304, and thereby defining a cavity configured to receive the insulation material 312 therein. More particularly, the support members 310 of the sidewall members 306*a,b* may each include an inner support member 404*a* and an outer support member 404*b* radially offset from the inner support member 404*a* so as to accommodate the insulation material 312 therebetween. One or both of the sidewall members 306*a,b* may further include the footing 402 positioned at the bottom thereof and configured to support insulation material 312 that may be stackable and/or consist of individual component materials. The footing 402 may extend horizontally from either the inner or outer support members 404*a,b* or otherwise extend therebetween.

With continued reference to FIG. 4B, in at least one embodiment, a thermal element 406 may be in thermal communication with the top member 306*c*. The thermal element 406 may be any device or mechanism configured to impart thermal energy to the mold 200 and, more particularly, through the top of the mold 200. For example, the thermal element 406 may be, but is not limited to, a heating element, a heat exchanger, a radiant heater, an electric heater, an infrared heater, an induction heater, a heating band, heated coils, heated fluids (flowing or static), an exothermic chemical reaction, or any combination thereof. Suitable configurations for a heating element may include, but not be limited to, coils, plates, strips, finned strips, and the like, or any combination thereof.

The thermal element 406 may be in thermal communication with the top member 306*c* via a variety of configurations. In the illustrated embodiment, for instance, the thermal element 406 is depicted as being embedded within the insulation material 312 of the top member 306*c*. In other embodiments, however, the thermal element 406 may interpose the insulation material 312 and the corresponding support member 310, interpose the top member 306*c* and the top of the mold 200, or interpose the top member 306*c* and the inner surface of the top of the outer shell 302, without departing from the scope of the disclosure. The thermal element 406 may be useful in helping facilitate the directional solidification of the molten contents of the mold 200 as it provides thermal energy to the top of the mold 200, while the thermal heat sink 206 draws thermal energy out the bottom 220 of the mold 200.

In some embodiments, one or more additional thermal elements (not shown) may also be placed in relation to the sidewall members 306*a,b* to facilitate directional cooling of the mold 200. For example, such thermal elements could be placed along the top third of the outer side surface of the mold 200 and could act in conjunction with or independent of the thermal element 406 that may be placed in relation to the top member 306*c*.

With reference to FIG. 4C, the sidewalls or sidewall members 306*a,b* of the inner shell 304 may be divided and otherwise include multiple sidewall segments 408 (shown as sidewall segments 408*a*, 408*b*, 408*c*, 408*d*, 408*e*, and 408*f*) stacked atop each other. As illustrated, the sidewall segments 408*a-f* are depicted as being stacked vertically and otherwise in direct contact with vertically adjacent sidewall segments 408*a-f*. Each sidewall segment 408*a-f* may be movably or compliantly coupled to the inner surface of the outer shell 302 using one or more compliant devices 308. As a result, each sidewall segment 408*a-f* may be independent of any adjacent sidewall segment 408*a-f* and otherwise separately engageable on the adjacent outer surfaces of the mold 200 as the insulation enclosure 400 is dropped over the mold 200.

Each sidewall segment 408*a-f* may include a support member 310 and insulation material 312 in accordance with any of the embodiments described herein. For instance, while the sidewall segments 408*a-f* depict the support member 310 as being positioned on the interior of the inner shell 304 with the insulation material 312 on the exterior of the inner shell 304, embodiments are contemplated herein where the support member 310 is positioned on the exterior of the inner shell 304 with the insulation material 312 on the interior thereof and adjacent the mold 200. In yet other embodiments, one or more of the sidewall segments 408*a-f* may be similar to the sidewall members 306*a,b* depicted in FIG. 4B, and include inner and outer support members 404*a,b* (FIG. 4B) with the insulation material 312 being positioned therebetween, without departing from the scope of the disclosure.

The size and/or thickness of the sidewall segments 408*a-f* may vary, depending on the application to advantageously alter the thermal resistance of each sidewall segment 408*a-f*, and thereby help control the thermal profile of the molten contents within the mold 200. In at least one embodiment, for instance, the thickness of the insulation material 312 corresponding to the lower sidewall segments 408*c* and 408*f* at or near the bottom 220 may be less than the thickness of the insulation material 312 corresponding to the upper sidewall segments 408*a* and 408*d* at or near the top of the mold 200. As a result, the thermal resistance of the lower sidewall segments 408*c* and 408*f* may be less than the thermal resistance of the upper sidewall segments 408*a* and 408*d*.

Alternatively, the thermal resistance of the sidewall segments 408*a-f* may be regulated or otherwise altered by using different types of insulation material 312. For example, the insulation material 312 corresponding to the lower sidewall segments 408*c* and 408*f* may exhibit a first thermal resistance and the insulation material 312 corresponding to the upper sidewall segments 408*a* and 408*d* may exhibit a second thermal resistance, where the first thermal resistance is less than the second thermal resistance.

As will be appreciated, any of the above-described embodiments and/or features depicted in FIGS. 3 and 4A-4C may be interchangeable and/or duplicated, without departing from the scope of the disclosure. Moreover, exemplary operation of the insulation enclosure 400 depicted in FIGS. 4A-4C may be substantially similar to the operation of the insulation enclosure 300 of FIG. 3, and therefore will not be described again.

FIGS. 5A-5E are various cross-sectional top views of exemplary insulation enclosures, according to one or more embodiments. Each insulation enclosure depicted in FIGS. 5A-5E may be similar to (or the same as) one or both of the insulation enclosures 300 and 400 described above with reference to FIGS. 3 and 4A-4C. Accordingly, the insulation enclosures of FIGS. 5A-5E may be further understood with reference to the insulation enclosures 300, 400 of those other figures, where like numerals will indicate like elements or components that will not be described again in detail. In the embodiments of FIGS. 5A-5E, the mold 200 is depicted as exhibiting a substantially circular cross-section. Those skilled in the art will readily appreciate, however, that the mold 200 may alternatively exhibit other cross-sectional shapes including, but not limited to, ovular, polygonal, polygonal with rounded corners, or any hybrid thereof.

Figure 5A:
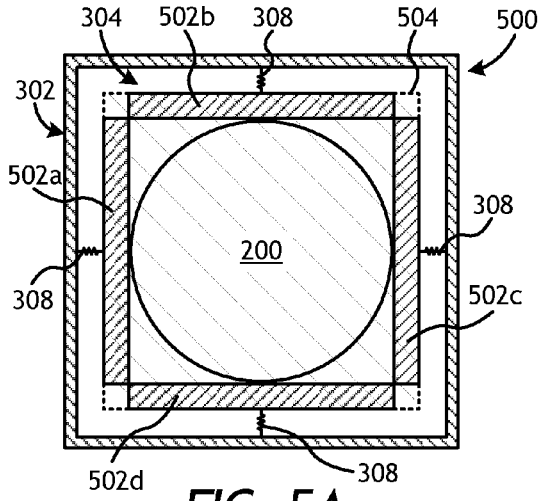
FIGS. 5A-5E illustrate various cross-sectional top views of exemplary insulation enclosures, according to one or more embodiments.

In FIG. 5A, an exemplary insulation enclosure 500 is depicted as having a substantially square horizontal cross-sectional shape. More particularly, the outer shell 302 may be square and the inner shell 304 may also be square in shape and include four sidewall members 502 (shown as sidewall members 502*a*, 502*b*, 502*c*, and 502*d*). While not specifically labeled, similar to the sidewall members 306*a,b* of FIGS. 3 and 4A-4C, each sidewall member 502*a-d* may be a composite structure made of a support member 310 (FIGS. 3 and 4A-4C) and insulation material 312 (FIGS. 3 and 4A-4C).

The sidewall members 502*a-d* may each be movably and/or compliantly coupled to corresponding inner surfaces of the outer shell 302 using one or more compliant devices 308. As a result, movement of each sidewall member 502*a-d* may be independent of movement of any adjacent sidewall member 502*a-d* and otherwise separately engageable on the outer surface of the mold 200 as the insulation enclosure 500 is dropped over the mold 200.

The inner shell 304 may further include a top member 504 (shown in dashed and phantom lines). In some embodiments, the top member 504 may also exhibit a generally square shape, as depicted. In such embodiments, the sidewall members 502*a-d* and the top member 504 may cooperatively define a box-like structure. In other embodiments, however, the top member 504 may exhibit other shapes including, but not limited to, circular, ovular, or any other polygonal shape sufficient to substantially cover the top of the sidewall member 502*a-d*.

While not specifically labeled, similar to the top member 306*c* of FIGS. 3 and 4A-4C, the top member 504 may be a composite structure made of a support member 310 (FIGS. 3 and 4A-4C) and insulation material 312 (FIGS. 3 and 4A-4C). Moreover, similar to the top member 306*c* of FIGS. 3 and 4A-4C, the top member 504 may be movably or compliantly coupled to a top inner surface of the outer shell 302 with one or more compliant devices 308 (not shown for the top member 504).

Figure 5B:
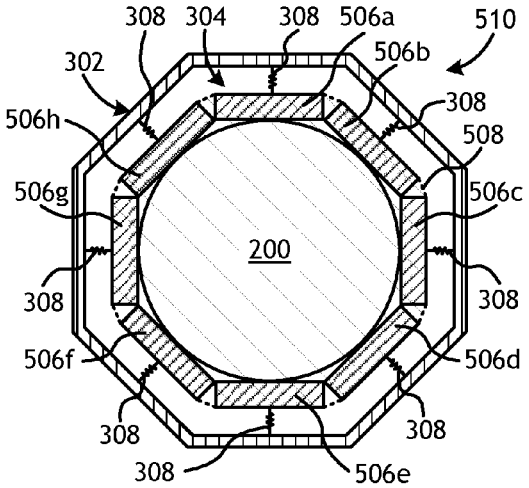

In FIG. 5B, another exemplary insulation enclosure 510 is depicted as exhibiting a substantially octagonal horizontal cross-sectional shape. More particularly, the outer shell 302 may be octagonal and the inner shell 304 may also be octagonal in shape by including eight sidewall members 506 (shown as sidewall members 506*a*, 506*b*, 506*c*, 506*d*, 506*e*, 506*f*, 506*g*, and 506*h*). While not specifically labeled, each sidewall member 506*a-h* may be a composite structure made of a support member 310 (FIGS. 3 and 4A-4C) and insulation material 312 (FIGS. 3 and 4A-4C).

The sidewall members 506*a-h* may each be movably or compliantly coupled to corresponding inner surfaces of the outer shell 302 using one or more compliant devices 308. As a result, each sidewall member 506*a-h* may be independent of any adjacent sidewall member 506*a-h* and otherwise separately engageable on adjacent outer surfaces of the mold 200 as the insulation enclosure 510 is dropped over the mold 200. In some applications, the octagonal shape of the insulation enclosure 510 may allow more contact with the mold 200 than with the square shape of the insulation enclosure 500. As a result, the insulation enclosure 510 may be able to more efficiently or effectively regulate the thermal profile of the mold 200 by increasing or maximizing heat transfer via conduction rather than via radiation.

The inner shell 304 may further include a top member 508 (shown in dashed and phantom lines). In some embodiments, the top member 508 may also exhibit a generally octagonal shape, but may equally be circular, ovular, or any other polygonal shape, without departing from the scope of the disclosure. The top member 508 may be movably or compliantly coupled to a top inner surface of the outer shell 302 with one or more compliant devices 308 (not shown for the top member 508). Moreover, while not specifically labeled, the top member 508 may be a composite structure made of a support member 310 (FIGS. 3 and 4A-4C) and insulation material 312 (FIGS. 3 and 4A-4C).

Figure 5C:
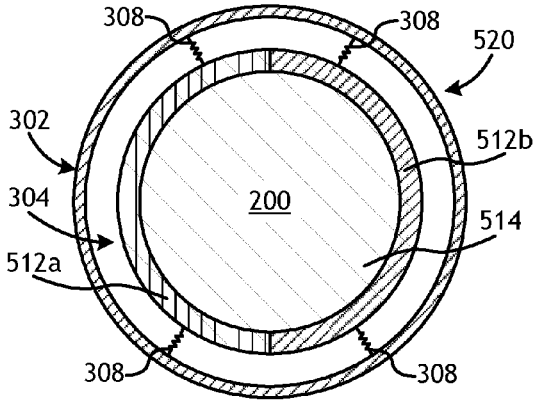

In FIG. 5C, another exemplary insulation enclosure 520 is provided and exhibits a substantially circular horizontal cross-sectional shape. More particularly, the outer shell 302 may be circular and the inner shell 304 may also be circular in shape and include two arcuate sidewall members 512 (shown as sidewall members 512*a* and 512*b*). As used herein, the term "arcuate" refers to an arc-like structure or segment. While not specifically labeled, each arcuate sidewall member 512*a,b* may be a composite structure made of a support member 310 (FIGS. 3 and 4A-4C) and insulation material 312 (FIGS. 3 and 4A-4C). Moreover, the arcuate sidewall members 512*a,b* may each be movably or compliantly coupled to the inner surface of the outer shell 302 using one or more compliant devices 308. As a result, each arcuate sidewall member 512*a,b* may be independent of the other and separately engageable on the outer surface of the mold 200 as the insulation enclosure 520 is dropped over the mold 200.

The inner shell 304 may further include a top member 514 (shown in dashed and phantom lines). In some embodiments, the top member 514 may also exhibit a generally circular shape, as depicted, but may equally be ovular or any polygonal shape, without departing from the scope of the disclosure. The top member 514 may be movably or compliantly coupled to a top inner surface of the outer shell 302 with one or more compliant devices 308 (not shown for the top member 514). Moreover, while not specifically labeled, the top member 514 may be a composite structure made of a support member 310 (FIGS. 3 and 4A-4C) and insulation material 312 (FIGS. 3 and 4A-4C).

Figure 5D:
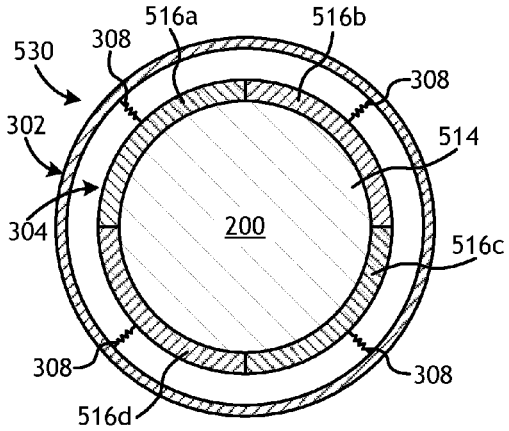

Similar to the insulation enclosure 520, FIG. 5D also depicts an exemplary insulation enclosure 530 that exhibits a substantially circular horizontal cross-sectional shape. The inner shell 304 may include the top member 514, but may further include four arcuate sidewall members 516 (shown as sidewall members 516*a*, 516*b*, 516*c*, and 516*d*). While not specifically labeled, each arcuate sidewall member 516*a-d* may be a composite structure made of a support member 310 (FIGS. 3 and 4A-4C) and insulation material 312 (FIGS. 3 and 4A-4C). Moreover, the sidewall members 516*a-d* may each be movably or compliantly coupled to the inner surface of the outer shell 302 using one or more compliant devices 308. As a result, each arcuate sidewall member 516*a-d* may be independent of the other sidewall members 516*a-d* and separately engageable on adjacent outer surfaces of the mold 200 as the insulation enclosure 530 is dropped over the mold 200.

Figure 5E:
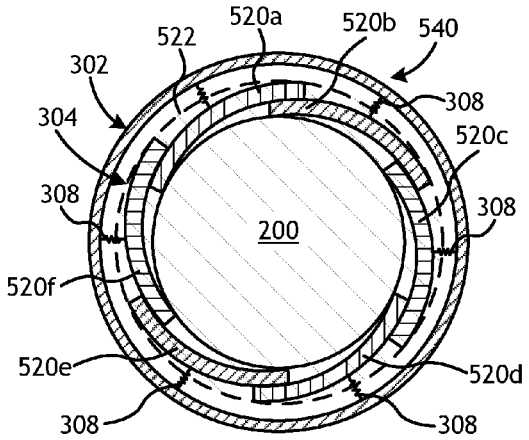

In FIG. 5E, another exemplary insulation enclosure 540 is depicted as exhibiting a substantially circular horizontal cross-sectional shape. More particularly, the outer shell 302 may be circular and the inner shell 304 may also be circular in shape and include six arcuate sidewall members 520 (shown as sidewall members 520*a*, 520*b*, 520*c*, 520*d*, 520*e*, and 520*f*). While not specifically labeled, each arcuate sidewall member 520*a-f* may be a composite structure made of a support member 310 (FIGS. 3 and 4A-4C) and insulation material 312 (FIGS. 3 and 4A-4C). Moreover, the arcuate sidewall members 520*a-f* may each be movably or compliantly coupled to the inner surface of the outer shell 302 using one or more compliant devices 308. As a result, each arcuate sidewall member 520*a-f* may be independent of the other sidewall members 520*a-f* and separately engageable on the outer surface of the mold 200 as the insulation enclosure 540 is dropped over the mold 200.

As illustrated, circumferentially adjacent sidewall members 520*a-f* may overlap each other a small distance to form an interleaved or nested relationship with one another. Such an interleaved relationship may prove advantageous in allowing the size (i.e., diameter) of the inner shell 304 to radially increase (or decrease) as the insulation enclosure 540 is dropped over the mold 200. For example, upon encountering a mold 200 that exhibits a particular diameter, the sidewall member 520*a-f* may be able to slidingly engage each other and thereby increase the circumference of the inner shell 304 without exposing the sides of the mold 200. Likewise, adjacent sidewall members 520*a-f* may also be able to slidingly engage each other to decrease the circumference of the inner shell 304 and thereby accommodate a mold 200 having a smaller size.

The inner shell 304 may further include a top member 522 (shown in dashed and phantom lines). In some embodiments, the top member 522 may also exhibit a generally circular shape, as depicted, but may equally be ovular or any polygonal shape, without departing from the scope of the disclosure. The top member 522 may be movably or compliantly coupled to a top inner surface of the outer shell 302 with one or more compliant devices 308 (not shown for the top member 522). Moreover, while not specifically labeled, the top member 522 may be a composite structure made of a support member 310 (FIGS. 3 and 4A-4C) and insulation material 312 (FIGS. 3 and 4A-4C).

Figure 6A:
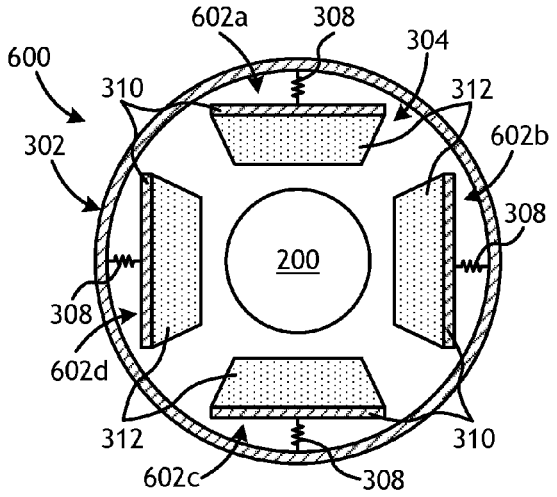
FIGS. 6A-6C illustrate cross-sectional top views of another exemplary insulation enclosure, according to one or more embodiments.
Figure 6B:
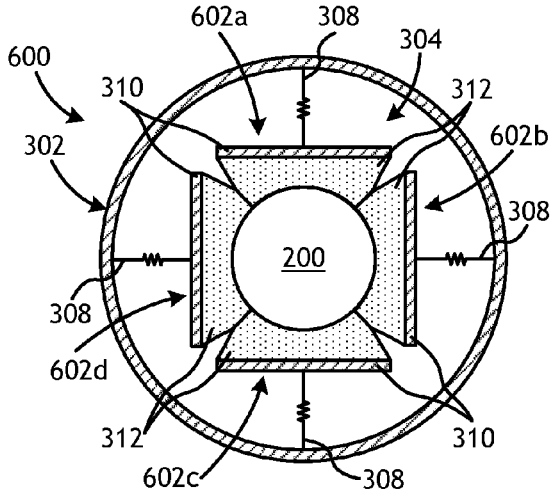
Figure 6C:
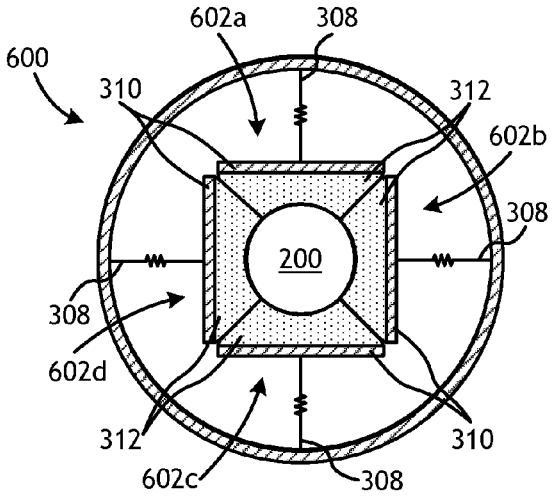

Referring now to FIGS. 6A-6C, with continued reference to FIGS. 5A-5E, illustrated are cross-sectional top views of another exemplary insulation enclosure 600, according to one or more embodiments. The insulation enclosure 600 may be similar to (or the same as) one or both of the insulation enclosures 300 and 400 described above with reference to FIGS. 3 and 4A-4C and therefore may be best understood with reference thereto, where like numerals will indicate like elements or components not described again. The mold 200 is again depicted as exhibiting a substantially circular cross-section, but may equally exhibit other cross-sectional shapes including, but not limited to, ovular, polygonal, polygonal with rounded corners, or any hybrid thereof.

The outer shell 302 may similarly exhibit a circular cross-sectional shape, and include four sidewall members 602 (shown as sidewall members 602*a*, 602*b*, 602*c*, and 602*d*). Similar to the sidewall members 306*a,b* of FIGS. 3 and 4A-4C, each sidewall member 602*a-d* may be a composite structure made of a support member 310 and insulation material 312. The sidewall members 602*a-d* may each be movably or compliantly coupled to the inner wall/surface of the outer shell 302 using one or more compliant devices 308. As a result, each sidewall member 602*a-d* may be independent of any adjacent sidewall member 602*a-d* and otherwise separately engageable on the outer surface of the mold 200 as the insulation enclosure 600 is dropped over the mold 200.

The insulation material 312 in FIGS. 6A-6C may be selected such that it is compressible or deformable. As a result, the insulation material 312 may be reusable or otherwise employed for a one-time use. In FIG. 6A, the compliant devices 308 are depicted in a retracted configuration so that the insulation material 312 of each sidewall member 602*a-d* is radially offset from the outer surfaces of the mold 200. In FIG. 6B, the compliant devices 308 are moved (e.g., actuated) to an expanded configuration and thereby urge the sidewall members 602*a-d* into physical engagement with the outer surfaces of the mold 200. As the sidewall members 602*a-d* engage the mold 200, the insulation material 312 may be configured to deform or otherwise crush against the outer surfaces of the mold 200. As illustrated, the mold 200 is large enough that the crushable insulation material 312 deforms enough to enclose the mold 200 in a suitable minimum amount of insulation material 312. In FIG. 6C, the insulation enclosure 600 is depicted in use with a mold 200 that is smaller than the mold in FIGS. 6A and 6B. The insulation material 312 in FIG. 6C deforms and completely encapsulates the mold 200 essentially out to the support members 310. Accordingly, the insulation enclosure 600 may be used to potentially accommodate a wide range of mold 200 sizes.

Embodiments disclosed herein include:

An insulation enclosure that includes an outer shell having an open end and a top end, an inner shell arranged within the outer shell and including a plurality of sidewall members and a top member, wherein each sidewall member is independently moveable relative to one another and to the top member, and wherein the plurality of sidewall members and the top member each include a support member and insulation material positioned on the support member, and one or more compliant devices arranged between the outer shell and at least one of the plurality of sidewall members and the top member, the one or more compliant devices biasing the at least one of the plurality of sidewall members and the top member against adjacent outer surfaces of a mold disposable within the inner shell.

B. A method that includes removing a mold from a furnace, the mold having a top and a bottom, placing the mold on a thermal heat sink with the bottom adjacent the thermal heat sink, lowering an insulation enclosure around the mold, the insulation enclosure having an outer shell and an inner shell disposable within the outer shell and the inner shell including a plurality of sidewall members and a top member, wherein one or more compliant devices are arranged between the outer shell and at least one of the plurality of sidewall members and the top member, and wherein each sidewall member is independently moveable relative to one another and to the top member, engaging adjacent outer surfaces of the mold with the plurality of sidewall members and the top member, each sidewall and top member including a support member and insulation material positioned on the support member, and cooling the mold axially upward from the bottom to the top.

C. A method that includes introducing a drill bit into a wellbore, the drill bit being formed within a mold heated in a furnace and subsequently cooled, wherein cooling the drill bit comprises removing the mold from the furnace, the mold having a top and a bottom, and placing the mold on a thermal heat sink with the bottom adjacent the thermal heat sink, lowering an insulation enclosure around the mold, the insulation enclosure having an outer shell and an inner shell disposable within the outer shell and the inner shell including a plurality of sidewall members and a top member, wherein one or more compliant devices are arranged between the outer shell and at least one of the plurality of sidewall members and the top member, and wherein each sidewall member is independently moveable relative to one another and to the top member, engaging adjacent outer surfaces of the mold with the plurality of sidewall members and the top member, each sidewall and top member including a support member and insulation material positioned on the support member, and cooling the mold axially upward from the bottom to the top, and drilling a portion of the wellbore with the drill bit.

Each of embodiments A, B, and C may have one or more of the following additional elements in any combination: Element 1: wherein the outer shell comprises an outer frame, an inner frame, and insulation material positioned between the inner and outer frames. Element 2: wherein the one or more compliant devices are at least one of a spring and an actuation device. Element 3: wherein the insulation material is a material selected from the group consisting of ceramics, ceramic fibers, ceramic fabrics, ceramic wools, ceramic beads, ceramic blocks, moldable ceramics, woven ceramics, cast ceramics, fire bricks, carbon fibers, graphite blocks, shaped graphite blocks, polymer beads, polymer fibers, polymer fabrics, nanocomposites, fluids in a jacket, metal fabrics, metal foams, metal wools, metal castings, any composite thereof, and any combination thereof. Element 4: further comprising a reflective coating positioned on an inner surface of one or more of the support members or on an inner surface of the outer shell. Element 5: further comprising an insulative coating positioned on at least one of an inner surface of one or more of the support members, and outer surface of one or more of the support members, and a surface of the outer shell. Element 6: wherein the support member of at least one of the plurality of sidewall members and the top member is positioned on an interior of the inner shell and the insulation material is positioned on an exterior of the inner shell. Element 7: wherein the support member of at least one of the plurality of sidewall members and the top member is positioned on an exterior of the inner shell and the insulation material is positioned on an interior of the inner shell. Element 8: wherein the support member for at least one of the plurality of sidewall members and the top member includes a footing that extends horizontally from the support member. Element 9: wherein the support member for at least one of the plurality of sidewall members and the top member includes an inner support member and an outer support member offset from the inner support member, and wherein the insulation material is positioned between the inner and outer support members. Element 10: further comprising a thermal element in thermal communication with at least one of the top member and one or more of the plurality of sidewall members to impart thermal energy to the mold. Element 11: wherein the thermal element comprising an element selected from the group consisting of a heating element, a heat exchanger, a radiant heater, an electric heater, an infrared heater, an induction heater, a heating band, heated coils, heated fluids (flowing or static), an exothermic chemical reaction, or any combination thereof. Element 12: wherein at least one of the plurality of sidewall members includes multiple sidewall segments stacked atop one another, each sidewall segment being movably coupled to the adjacent inner surface of the outer shell with the one or more compliant devices. Element 13: wherein a thermal resistance of the multiple sidewall segments increases from a bottom of the inner shell toward a top of the inner shell. Element 14: wherein a horizontal cross-sectional shape of at least one of the inner and outer shells is polygonal, circular, or ovular. Element 15: wherein the plurality of sidewall members are arcuate. Element 16: wherein adjacent sidewall members of the plurality of sidewall members are interleaved and slidingly engageable with one another when the inner shell radially expands or radially contracts.

Element 17: wherein engaging adjacent outer surfaces of the mold with the plurality of sidewall members and the top member comprises expanding the plurality of sidewall members and the top member outward to accommodate the mold, and biasing the plurality of sidewall members and the top member against the adjacent outer surfaces of the mold with the one or more compliant devices. Element 18: wherein at least one of the one or more compliant devices is an actuation device, the method further comprising actuating the actuation device to urge a corresponding one or more of the plurality of sidewall members and the top member into engagement with the adjacent outer surfaces of the mold. Element 19: wherein the plurality of sidewall members are arcuate and adjacent sidewall members of the plurality of sidewall members are interleaved, the method further comprising slidingly engaging the adjacent sidewall members with one another as the inner shell radially expands or radially contracts to engage the adjacent outer surfaces of the mold. Element 20: cooling the mold by conduction with the plurality of sidewall members and the top member engaged with the adjacent outer surfaces of the mold. Element 21: further comprising imparting thermal energy to the top of the mold with a thermal element in thermal communication with the top member, the thermal element comprising an element selected from the group consisting of a heating element, a heat exchanger, a radiant heater, an electric heater, an infrared heater, an induction heater, a heating band, heated coils, heated fluids (flowing or static), an exothermic chemical reaction, or any combination thereof. Element 22: further comprising drawing thermal energy from the bottom of the mold with the thermal heat sink. Element 23: wherein at least one of the plurality of sidewall members includes multiple sidewall segments stacked atop one another, each sidewall segment being movably coupled to the adjacent inner surface of the outer shell with the one or more compliant devices, the method further comprising increasing a thermal resistance of the multiple sidewall segments from a bottom of the inner shell toward a top of the inner shell.

Therefore, the disclosed systems and methods are well adapted to attain the ends and advantages mentioned as well as those that are inherent therein. The particular embodiments disclosed above are illustrative only, as the teachings of the present disclosure may be modified and practiced in different but equivalent manners apparent to those skilled in the art having the benefit of the teachings herein. Furthermore, no limitations are intended to the details of construction or design herein shown, other than as described in the claims below. It is therefore evident that the particular illustrative embodiments disclosed above may be altered, combined, or modified and all such variations are considered within the scope of the present disclosure. The systems and methods illustratively disclosed herein may suitably be practiced in the absence of any element that is not specifically disclosed herein and/or any optional element disclosed herein. While compositions and methods are described in terms of "comprising," "containing," or "including" various components or steps, the compositions and methods can also "consist essentially of" or "consist of" the various components and steps. All numbers and ranges disclosed above may vary by some amount. Whenever a numerical range with a lower limit and an upper limit is disclosed, any number and any included range falling within the range is specifically disclosed. In particular, every range of values (of the form, "from about a to about b," or, equivalently, "from approximately a to b," or, equivalently, "from approximately a-b") disclosed herein is to be understood to set forth every number and range encompassed within the broader range of values. Also, the terms in the claims have their plain, ordinary meaning unless otherwise explicitly and clearly defined by the patentee. Moreover, the indefinite articles "a" or "an," as used in the claims, are defined herein to mean one or more than one of the element that it introduces. If there is any conflict in the usages of a word or term in this specification and one or more patent or other documents that may be incorporated herein by reference, the definitions that are consistent with this specification should be adopted.

As used herein, the phrase "at least one of" preceding a series of items, with the terms "and" or "or" to separate any of the items, modifies the list as a whole, rather than each member of the list (i.e., each item). The phrase "at least one of" allows a meaning that includes at least one of any one of the items, and/or at least one of any combination of the items, and/or at least one of each of the items. By way of example, the phrases "at least one of A, B, and C" or "at least one of A, B, or C" each refer to only A, only B, or only C; any combination of A, B, and C; and/or at least one of each of A, B, and C.

What is claimed is:

1. An insulation enclosure, comprising:

an outer shell having an open end and a top end;

an inner shell arranged within the outer shell and including a plurality of sidewall members and a top member, wherein each sidewall member is independently moveable relative to one another and to the top member, and wherein the plurality of sidewall members and the top member each include a support member and insulation material positioned on the support member; and one or more compliant devices extending inwardly from the outer shell and outwardly from the at least one of the plurality of sidewall members, the one or more compliant devices biasing the at least one of the plurality of sidewall members against adjacent outer surfaces of a mold disposable within the inner shell.

2. The insulation enclosure of claim 1, wherein the outer shell comprises:

an outer frame;

an inner frame; and an insulation material positioned between the inner frame and the outer frame.

3. The insulation enclosure of claim 1, wherein the one or more compliant devices are at least one of a spring and an actuation device.

4. The insulation enclosure of claim 1, wherein the insulation material is a material selected from the group consisting of ceramic, ceramic fiber, ceramic fabric, ceramic wool, ceramic beads, ceramic blocks, moldable ceramics, woven ceramic, cast ceramic, fire brick, carbon fiber, graphite blocks, shaped graphite blocks, polymer beads, polymer fiber, polymer fabric, nanocomposites, a fluid in a jacket, metal fabric, metal foam, metal wool, a metal casting, any composite thereof, and any combination thereof.

5. The insulation enclosure of claim 1, further comprising a reflective coating positioned on an inner surface of at least one of one or more of the support members and the outer shell.

6. The insulation enclosure of claim 1, further comprising an insulative coating positioned on at least one of the following: an inner surface of one or more of the support members, an outer surface of one or more of the support members, and a surface of the outer shell.

7. The insulation enclosure of claim 1, wherein the support member of at least one of the plurality of sidewall members and the top member is positioned on an interior of the inner shell and the insulation material is positioned on an exterior of the inner shell.

8. The insulation enclosure of claim 1, wherein the support member of at least one of the plurality of sidewall members and the top member is positioned on an exterior of the inner shell and the insulation material is positioned on an interior of the inner shell.

9. The insulation enclosure of claim 1, wherein the support member for at least one of the plurality of sidewall members and the top member includes a footing that extends horizontally from the support member.

10. The insulation enclosure of claim 1, wherein the support member for at least one of the plurality of sidewall members and the top member includes an inner support member and an outer support member offset from the inner support member, and wherein the insulation material is positioned between the inner and outer support members.

11. The insulation enclosure of claim 1, further comprising a thermal element in thermal communication with at least one of the top member and one or more of the plurality of sidewall members to impart thermal energy to the mold.

12. The insulation enclosure of claim 11, wherein the thermal element comprising an element selected from the group consisting of a heating element, a heat exchanger, a radiant heater, an electric heater, an infrared heater, an induction heater, a heating band, heated coils, heated fluids (flowing or static), an exothermic chemical reaction, or any combination thereof.

13. The insulation enclosure of claim 1, wherein at least one of the plurality of sidewall members includes multiple sidewall segments stacked atop one another, each sidewall segment being movably coupled to an adjacent inner surface of the outer shell with the one or more compliant devices.

14. The insulation enclosure of claim 13, wherein a thermal resistance of the multiple sidewall segments increases from a bottom of the inner shell toward a top of the inner shell.

15. The insulation enclosure of claim 1, wherein a horizontal cross-sectional shape of at least one of the inner and outer shells is polygonal, circular, or ovular.

16. The insulation enclosure of claim 1, wherein the plurality of sidewall members are arcuate.

17. The insulation enclosure of claim 16, wherein adjacent sidewall members of the plurality of sidewall members are interleaved and slidingly engageable with one another when the inner shell radially expands or radially contracts.

18. The insulation enclosure of claim 1, wherein the one or more compliant devices are further arranged between the outer shell and the top member to bias the top member against an adjacent outer surface of the mold.

* * * * *